US010166689B2

(12) United States Patent
Chang

(10) Patent No.: US 10,166,689 B2
(45) Date of Patent: Jan. 1, 2019

(54) TURRET PUNCH

(71) Applicant: Ji-Jong Chang, Taichung (TW)

(72) Inventor: Ji-Jong Chang, Taichung (TW)

( * ) Notice: Subject to any disclaimer, the term of this patent is extended or adjusted under 35 U.S.C. 154(b) by 71 days.

(21) Appl. No.: 15/197,759

(22) Filed: Jun. 30, 2016

(65) Prior Publication Data

US 2018/0001502 A1 Jan. 4, 2018

(51) Int. Cl.
*B26F 1/36* (2006.01)

(52) U.S. Cl.
CPC ..... *B26F 1/36* (2013.01); *B26F 2001/365* (2013.01)

(58) Field of Classification Search
CPC ..... B26F 1/32; B26F 1/36; B26F 2001/365
USPC ..... 30/364
See application file for complete search history.

(56) References Cited

U.S. PATENT DOCUMENTS 618,022 A * 1/1899 Baltzer ..... B26F 1/36 30/364
734,157 A * 7/1903 Bernard ..... B26F 1/36 30/364
1,308,272 A * 7/1919 Berglund ..... B26F 1/36 30/364
6,282,796 B1 * 9/2001 Lin ..... B25B 7/04 30/363
7,146,738 B2 * 12/2006 Yu ..... B26F 1/36 30/358

FOREIGN PATENT DOCUMENTS

DE 9410251 U1 * 10/1994 ..... B25B 7/02
DE 102006024285 A1 * 12/2006 ..... B25B 7/04

* cited by examiner

*Primary Examiner* — Jennifer Swinney

(57) ABSTRACT

A turret punch includes a first body, a second body, a third body, a pin, a first resilient member, a turret, function members, a second resilient member and a connector. The second rail portion of the third body is linearly movable along the first rail portion of the first body. When operating the first and second bodies, the function member that is located corresponding to the first function end moves linearly so as to be engaged with or to be disengaged from the first function end of the first body, such that the holes are punched along a straight line.

8 Claims, 14 Drawing Sheets

TURRET PUNCH

BACKGROUND OF THE INVENTION

1. Fields of the Invention

The present invention relates to a punch, and more particularly, to a turret punch wherein the second rail portion of the third body is linearly movable along the first rail portion of the first body. When operating the first and second bodies, the function member that is located corresponding to the first function end moves linearly so as to be engaged with or to be disengaged from the first function end of the first body, such that the holes are punched along a straight line.

2. Descriptions of Related Art

The conventional turret punch disclosed in U.S. Pat. No. 4,193,191 comprises a first body and a second body which is pivotably connected to the first body at a position about ⅓ of the lengthwise of the first and second bodies. The second body has a reception hole defied in an end of the second body.

A turret is pivotably connected to the second body and has multiple function member which are located around the turret. The turret is rotatable relative to the second body to align one of the function members with the function end of the first body. The turret has multiple positioning portions on one side thereof and located corresponding the spaced distances of the function members. The reception hole of the second body is able to be located corresponding to different positioning portions.

A resilient plate is fixed to the second body, and a bead is received in the reception hole of the second body. The resilient plate has one end contacting the bead to resilient bias the bead toward one of the positioning portions so that the turret is positioned relative to the second body when being rotated.

The turret has the function members and one of the function members is aligned with the function end of the first body. A resilient member is connected between the first and second bodies so as to provide a resilient force between the pivotably connected first and second bodies. When the user pushes the handles of the first and second bodies, the function member moves along a curved path to be engaged with the function end. However, the curved path that the function member moves along makes the hole punched to be shaped slightly curved. Generally, if the object to be punched is a piece of fabric which has thinner thickness, the slightly curved holes are acceptable. If the object to be punched is a thick object, the slightly curved holes affect the cooperation with other parts.

Taiwan Patent Application No. 102211861 with the certificate number M466000, as disclosed in FIGS. 1 and 2 thereof, the turret punch is similar to that disclosed in U.S. Pat. No. 4,193,191, wherein the punch heads move along a curve path and are connected to the board, so that the punched holes are slightly curved which has the same problem as the turret punch disclosed in U.S. Pat. No. 4,193,191.

SUMMARY OF THE INVENTION

In order to improve the problem of the curved punched holes of the conventional turret punches, the second rail portion of the third body is linearly movable along the first rail portion of the first body. When operating the first and second bodies, the function member that is located corresponding to the first function end moves linearly so as to be engaged with or to be disengaged from the first function end of the first body, such that the holes which are punched along a straight line.

The present invention relates to a turret punch and comprises a first body, a second body, a third body, a pin, a first resilient member, a turret, function members, a second resilient member and a connector. The second rail portion of the third body is linearly movable along the first rail portion of the first body. When operating the first and second bodies, the function member that is located corresponding to the first function end moves linearly so as to be engaged with or to be disengaged from the first function end of the first body, such that the holes are punched along a straight line.

When compared with the conventional turret punches mentioned above, it is noted that when the user pushes the two respective handles of the first and second bodies, the control portion is engaged with the third control recess of the third body, and the control portion drives the second rail portion of the third body to linearly move along the first rail portion of the first body. The function member that is located corresponding to the first function end moves linearly so as to be engaged with or to be disengaged from the first function end of the first body, such that the holes are punched along a straight line.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
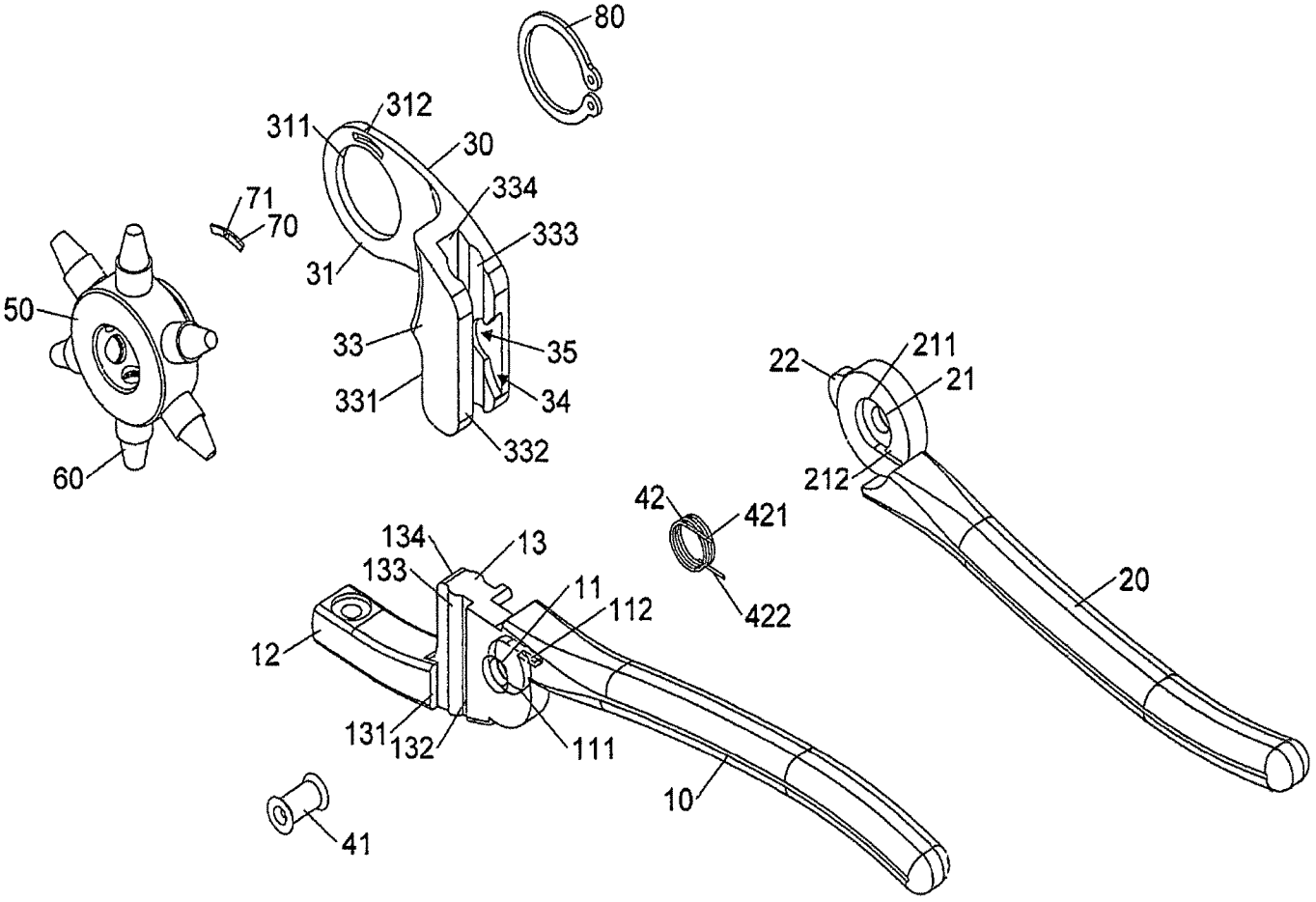
FIG. 1 is an exploded view of the turret punch of the present invention.
Figure 2:
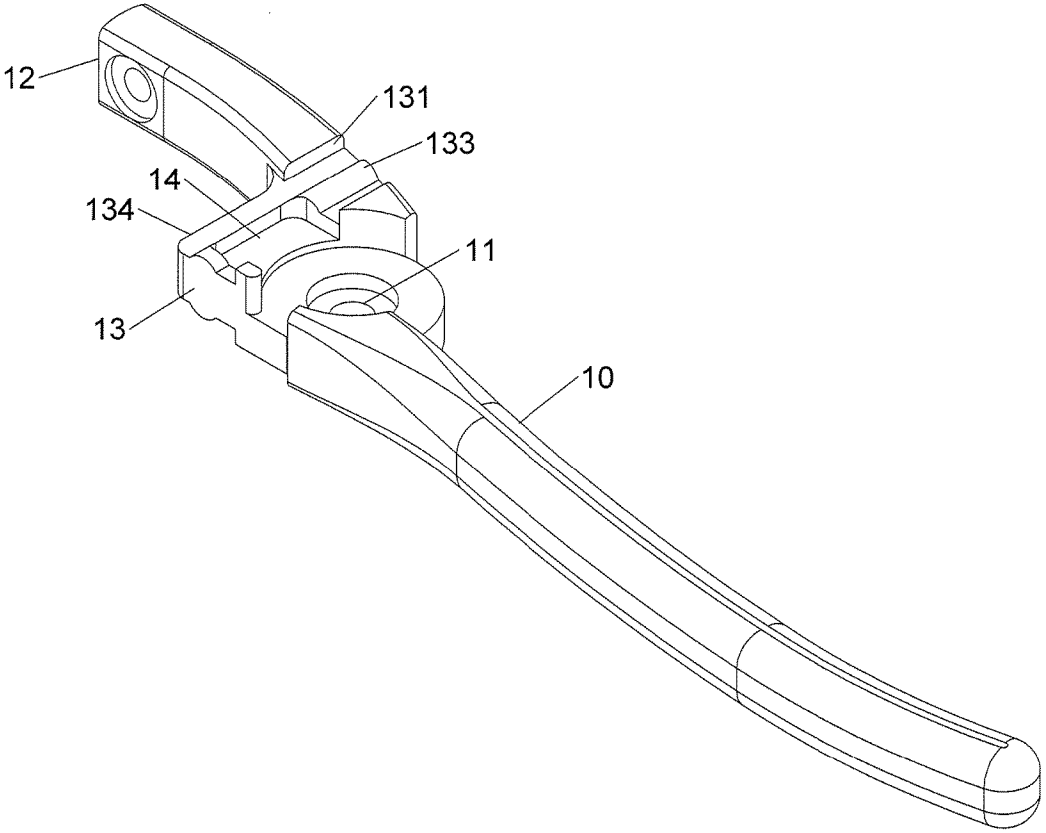
FIG. 2 is a perspective view to show the first body of the turret punch of the present invention.
Figure 3:
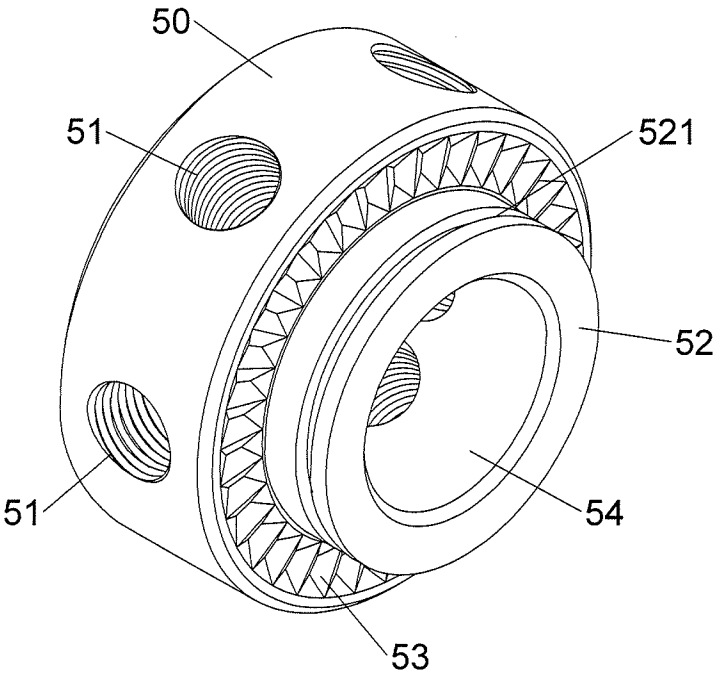
FIG. 3 is a perspective view to show the turret of the turret punch of the present invention.

Referring to FIGS. 1 to 3, the turret punch of the present invention comprises a first body 10 having a first pivotal hole 11. The first pivotal hole 11 has a first recess 111 and a first engaging slot 112. The first pivotal hole 11 co-axially communicates with the first recess 111. The first recess 111 and the first engaging slot 112 are arranged as "6". A first function end 12 is formed at the distal end thereof. A first rail portion 13 is formed between the first pivotal hole 11 and the first function end 12. Each of two sides of the first rail portion 13 has a first side 131 and a second side 132 which is parallel to the first side 131 and faces the first side 131 with a distance located therebetween. A third side 133 is formed at the mediate portion of each of the two sides of the first rail portion 13 and located between the first and second sides 131, 132. A fourth side 134 is formed at an end of the first rail portion 13 and is perpendicular to each of the first sides 131. The first rail portion 13 has a first control recess 14 defined therein which is located close to the first pivotal hole 11.

A second body 20 has a second pivotal hole 21 which is located corresponding to the first pivotal hole 11. The second pivotal hole 21 has a second recess 211 and a second engaging slot 212. The second pivotal hole 21 co-axially communicates with the second recess 211. The second recess 211 and the second engaging slot 212 are arranged as "6". The second recess 211 and the first recess 111 together define a room. A control portion 22 is formed at the distal end of the second body 20 and is a protrusion. The control portion 22 is located in the first control recess 14 and movable along a curved path in the control recess 14.

A third body 30 is connected to the first body 10 and has a second function end 31 on the first end thereof. The second function end 31 is located corresponding to the first function end 12. The second function end 31 has a first pivotal portion 311 which is a circular hole. The second function end 31 has a reception slot 312 defined therethrough which is a curved slot. A second rail portion 33 is formed in the second end of the third body 30. The first rail portion 13 is slidably engaged with the second rail portion 33. Each of two insides of the second rail portion 33 has a fifth side 331 and a sixth side 332. The fifth sides 313 is slidably engaged with the first sides 131. The sixth sides 332 is slidably engaged with the second sides 132. A seventh side 333 is defined in each of the two insides of the second rail portion 33 and slidably engaged with the third sides 133. The seventh sides 333 each are a groove. An eighth side 334 is formed at the second rail portion 33 and slidably engaged with the fourth side 134. The second rail portion 33 has a second control recess 34 with which a portion with the second recess 211 is accommodated. The second control recess 34 is located at an inside of the second rail portion 33 and located corresponding to the first control recess 14. A third control recess 35 is defined in the second rail portion 33 and communicates with the second control recess 34. The control portion 22 is accommodated in the third control recess 35. The third control recess 35 is located at the inside of the second rail portion 33 and located corresponding to the first control recess 14. When the second body 20 is pivoted about the first pivotal hole 11 or the second pivotal hole 21, the control portion 22 pushing the third control recess 35 to linearly move the second rail portion 33 along the first rail portion 13 so as to move the second function end 31 of the third body 30 close to or away from the first function end 12.

When designing the turret punch, the control portion 22 of the second body 20 is a rounded protrusion. The third control recess 35 of the third body 30 is shaped to accommodate the control portion 22. The diameter of the third control recess 35 is larger than that of the control portion 22. This makes the designer to design the control portion 22 and the third control recess 35.

A pin 41 extends through the first and second pivotal holes 11, 21 to pivotably connect the first body 10 to the second body 20. The pin 41 is a cylindrical pin.

A first resilient member 42 located between the first and second bodies 10, 20 to resiliently bias the first and second bodies 10, 20. The first resilient member 42 is received in the room defined by the second recess 211 and the first recess 111. The first resilient member 42 is mounted to the pin 41. The first resilient member 42 has a first leg 421 and a second leg 422, wherein the first leg 421 is engaged with the first engaging slot 112, and the second leg 422 is engaged with the second engaging slot 212. The first body 10 resiliently contacts the second body 20 by the first resilient member 42. The first resilient member is a coil spring.

A turret 50 is pivotably connected to the second function end 31 of the third body 30 and has multiple installation holes 51 which are located on the outside of the turret 50 and arranged as a circle. Each of the installation holes 51 includes inner threads. A second pivotal portion 52 is defined centrally of the turret 50 and pivotably connected with the first pivotal portion 311. A connection portion 521 is a groove and located on outside of the second pivotal portion 52. Multiple positioning portions 53 are located on the end surface where the second pivotal portion 52 extends. One of the positioning portions 53 is located corresponding to the reception slot 312. The second pivotal portion 52 has a passage 54 which is a circular passage. There are multiple function members 60, and each of the installation hole 51 receives one of the function members 60. Each of the function members 60 is located corresponding to the first function end 12 of the first body 10. The function members 60 each have a specific size and specification. When the user pushes the two respective handles of the first and second bodies 10, 20, the control portion 22 of the second body 20 drives the second rail portion 33 of the third body 30 to linearly move along the first rail portion 13 of the first body 10. The function member 60 that is located corresponding to the first function end 12 moves linearly so as to be engaged with or to be disengaged from the first function end 12 of the first body 10, such that the holes are punched along a straight line.

A second resilient member 70 is received in the reception slot 312 of the third body 30 and has a second positioning portion 71 which is a ridge and protrudes beyond the reception slot 312. The second positioning portion 71 is engaged with any one of the positioning portions 53 so as to change the function members 60 by rotating the turret 50 and to prevent the turret 50 from freely rotating. The turret 50 is positioned by the second resilient member 70 which is an integral member.

A connector 80 is engaged with the connection portion 521 and contacts outside of the second function end 31 so that the turret 50 is restricted by the connector 80 and is not disengaged from the second function end 31. The connector 80 is a circular clip.

Figure 4:
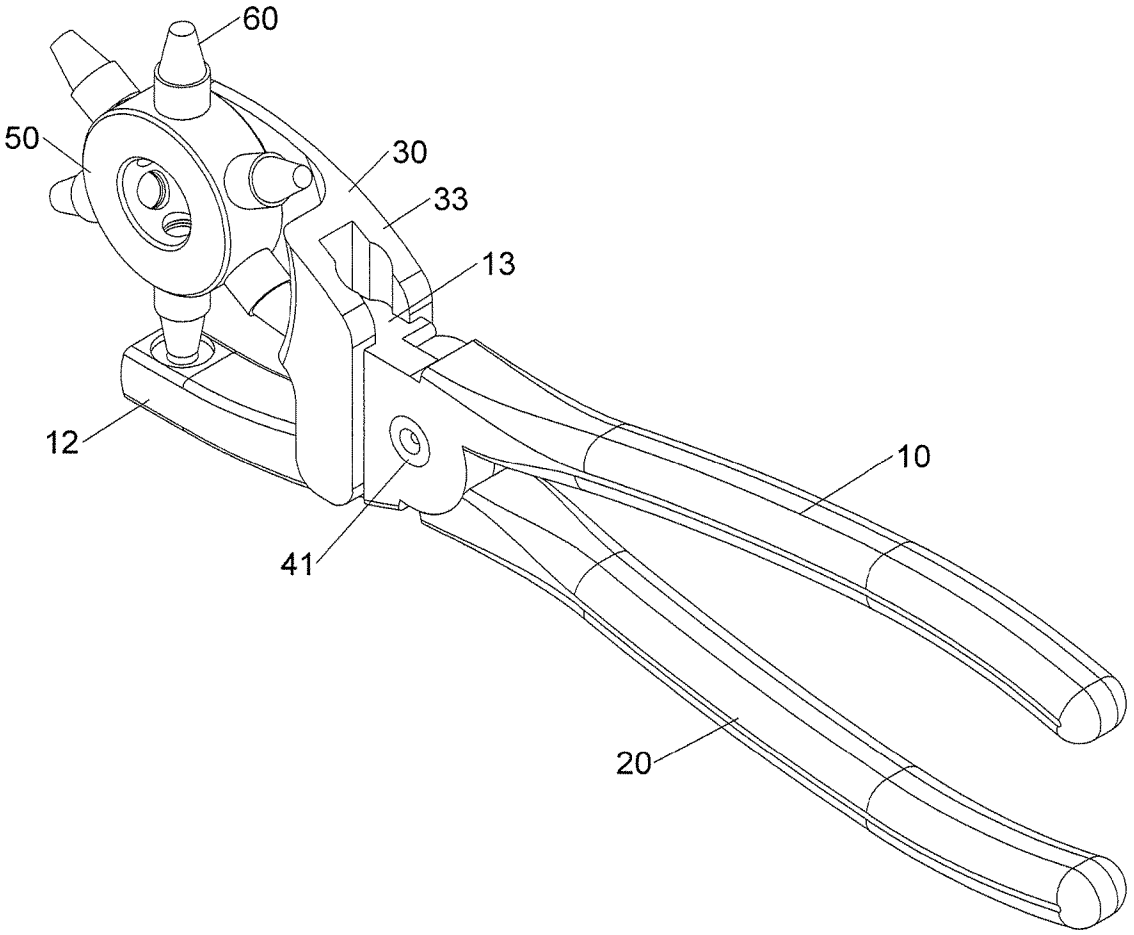
FIG. 4 is a perspective view to show the turret punch of the present invention.
Figure 5:
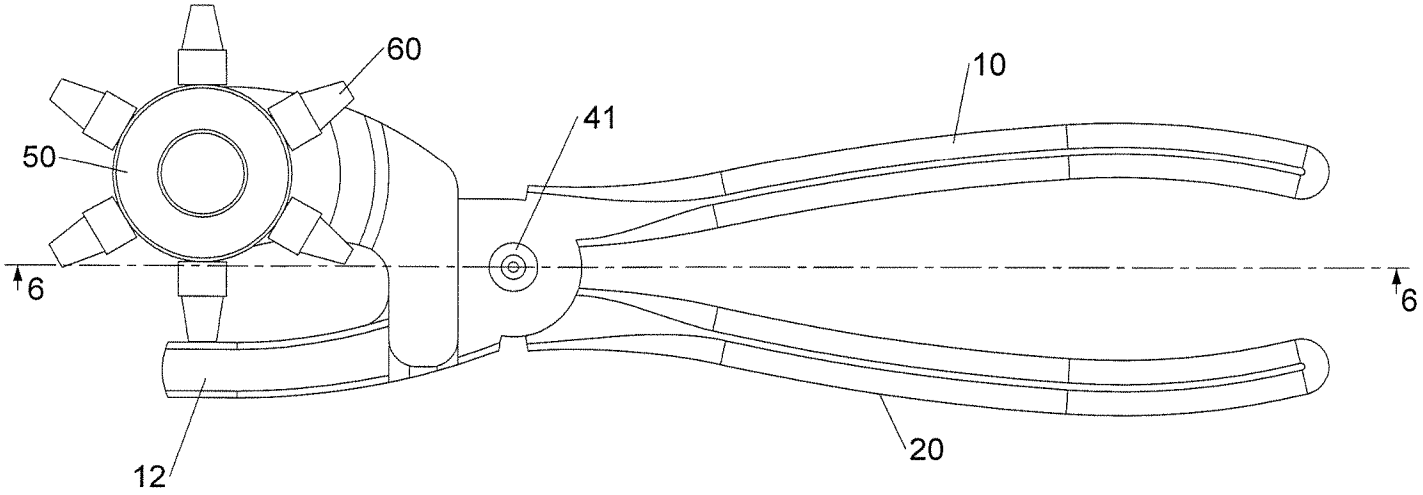
FIG. 5 is a front view to show the turret punch of the present invention.
Figure 6:
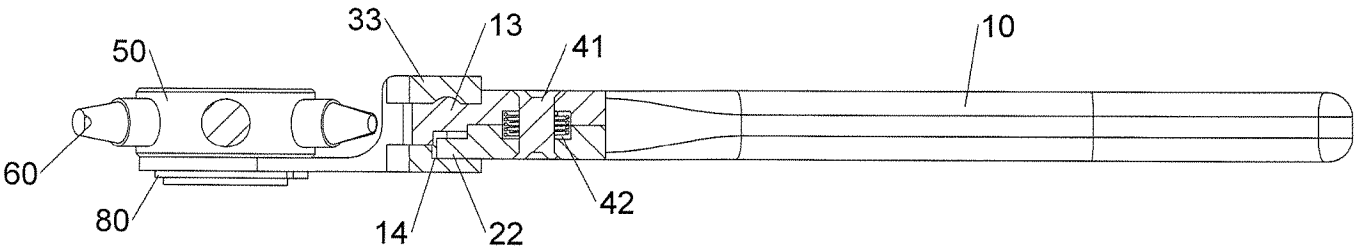
FIG. 6 is a cross sectional view, taken along line 6-6 in FIG. 5.
Figure 7:
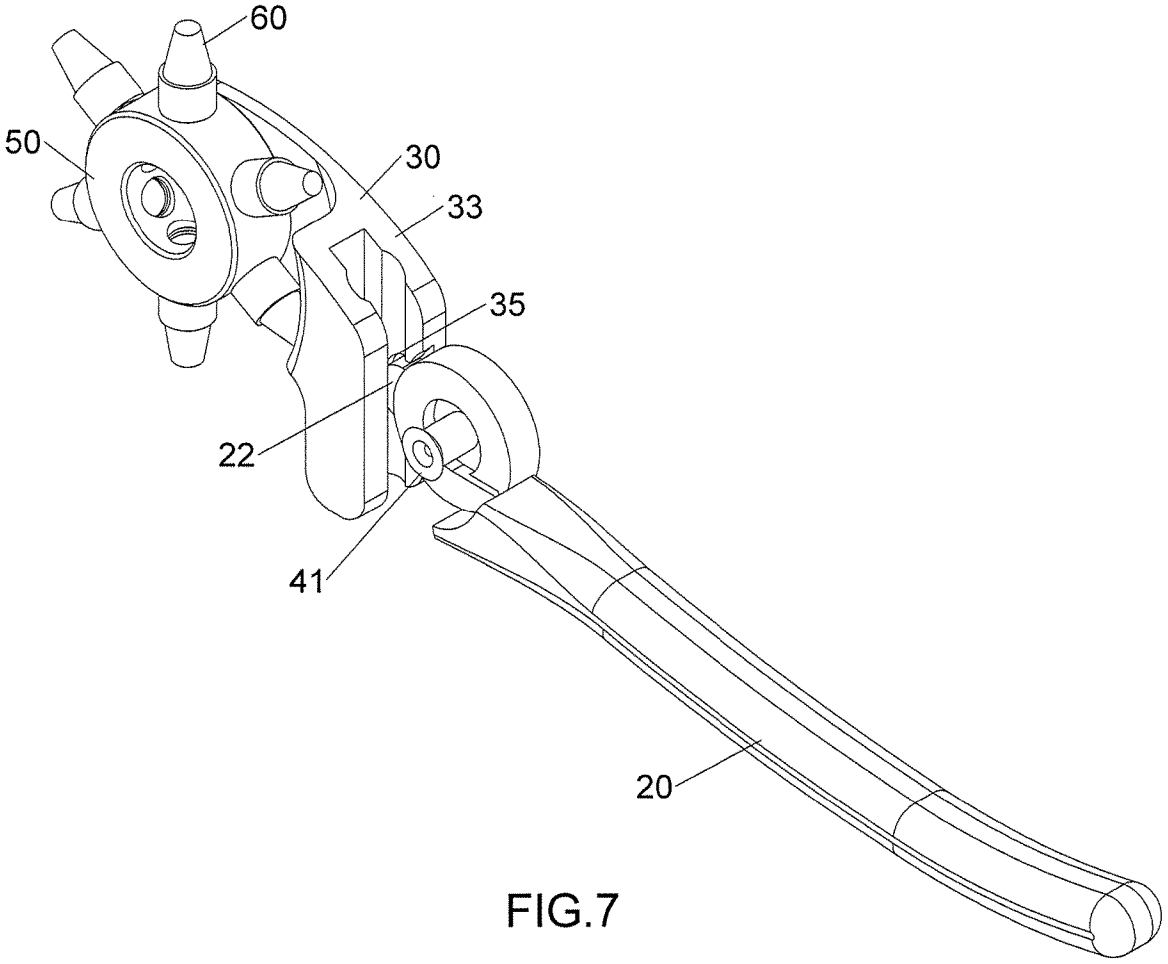
FIG. 7 shows a portion of the turret punch of the present invention.
Figure 8:
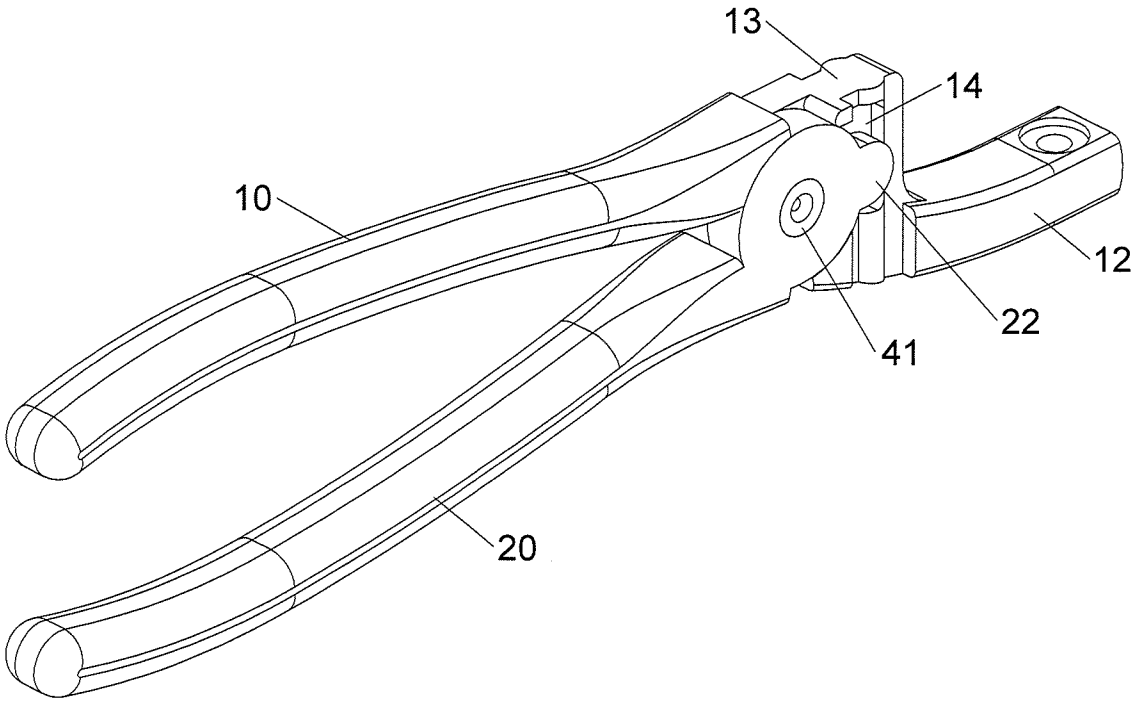
FIG. 8 is another perspective view to show the combination of the first body and the second body of the turret punch of the present invention.

When the turret punch is assembled, FIG. 4 shows the perspective view to show the turret punch of the present invention. FIG. 5 is a front view to show the turret punch of the present invention. FIG. 6 is a cross sectional view, taken along line A-A in FIG. 5. FIG. 7 shows a portion of the turret punch of the present invention. FIG. 8 is another perspective view to show the combination of the first body and the second body of the turret punch of the present invention.

Figure 9:
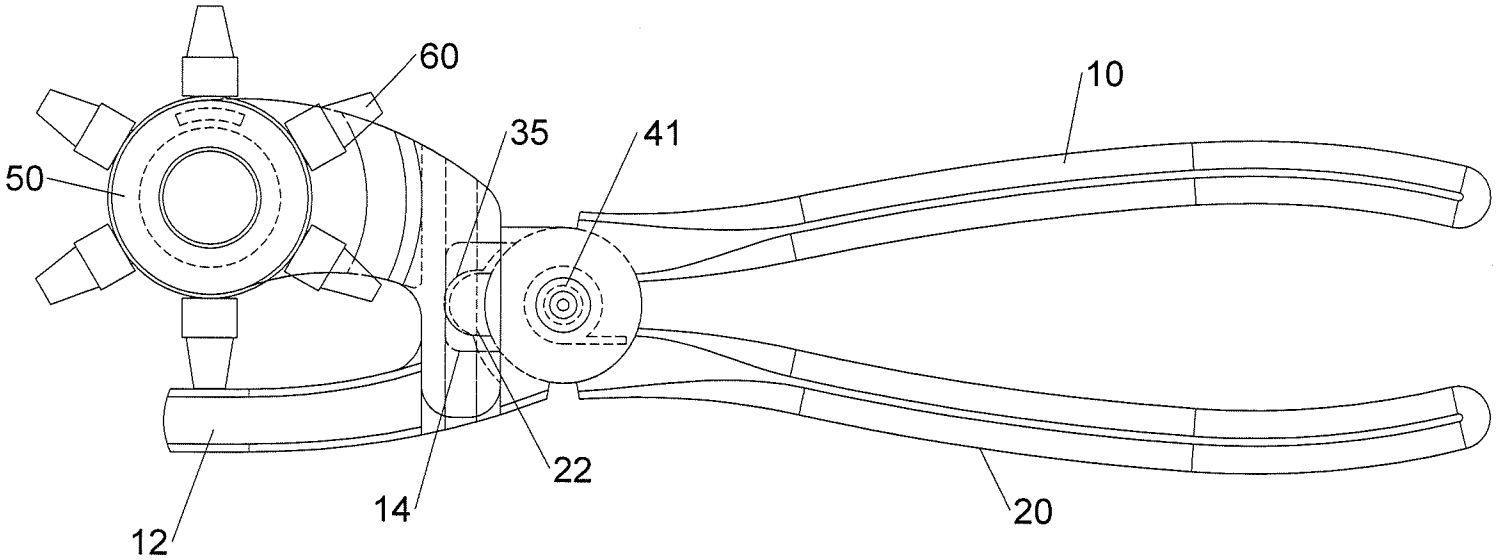
FIG. 9 shows the first operational status of the turret punch of the present invention.
Figure 10:
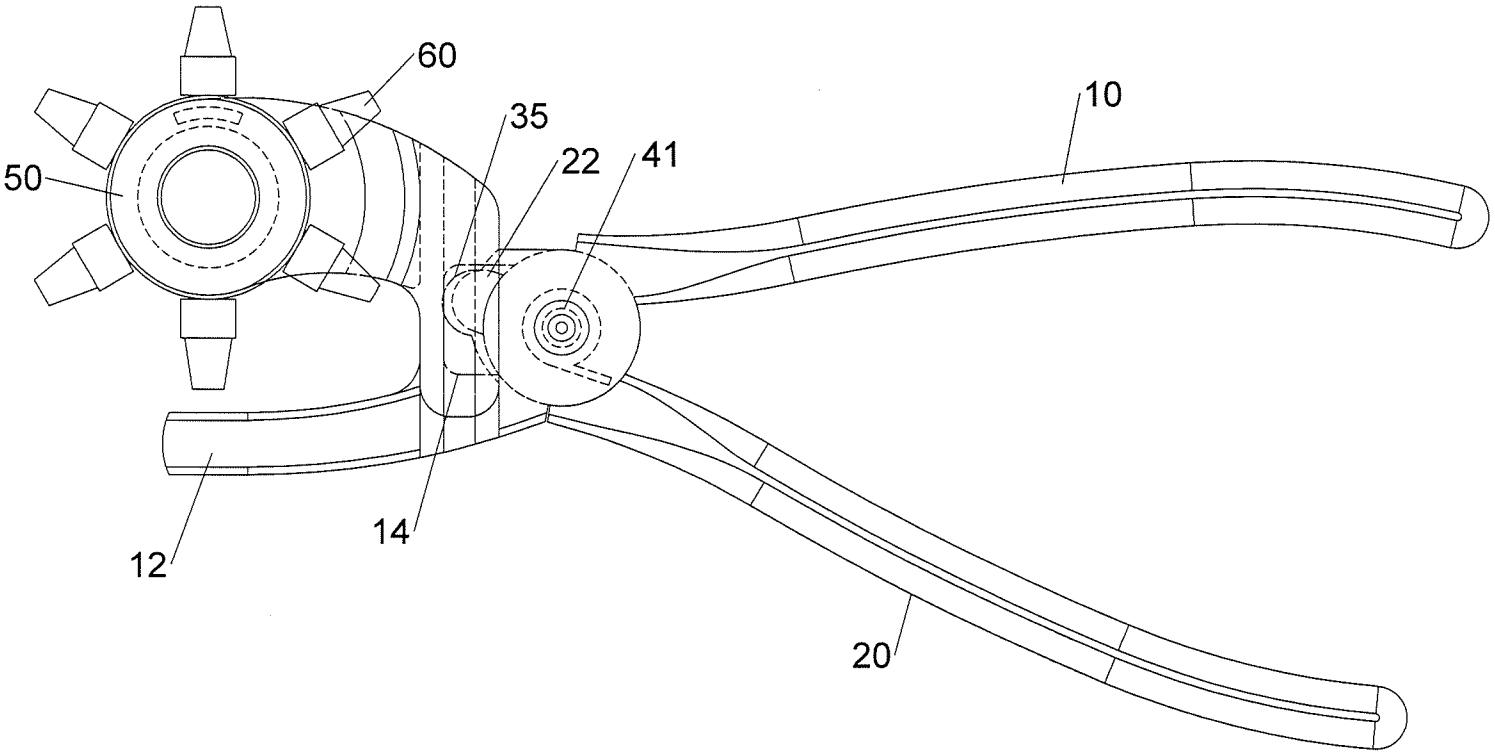
FIG. 10 shows the second operational status of the turret punch of the present invention.

As shown in FIGS. 9 and 10, which show the first and second operational statuses. When the user pushes the two respective handles of the first and second bodies 10, 20, the control portion 22 of the second body 20 drives the second rail portion 33 of the third body 30 to linearly move along the first rail portion 13 of the first body 10. The function member 60 that is located corresponding to the first function end 12 moves linearly so as to be engaged with or to be disengaged from the first function end 12 of the first body 10, such that the holes are punched along a straight line.

Figure 11:
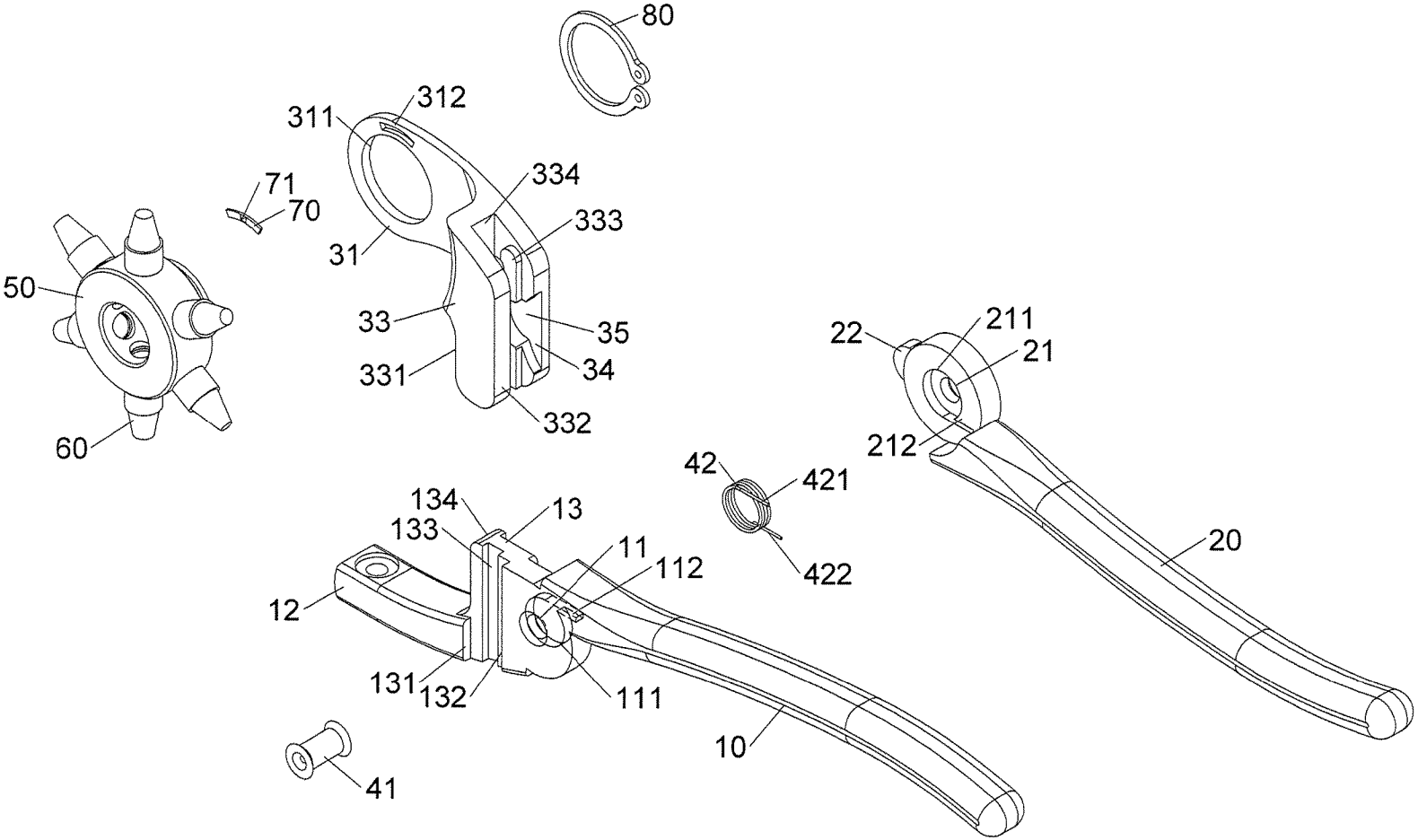
FIG. 11 is an exploded view of the second embodiment of the turret punch of the present invention.

As shown in FIG. 11 which shows the second embodiment of the present invention, wherein the third sides 133 of the first rail portion 13 of the first body 10 each are a groove or a concave curved recess. The seventh sides 333 of the second rail portion 33 of the third body 30 each are a protrusion or a rounded protrusion. The third sides 133 are engaged with the seventh sides 333.

Figure 12:
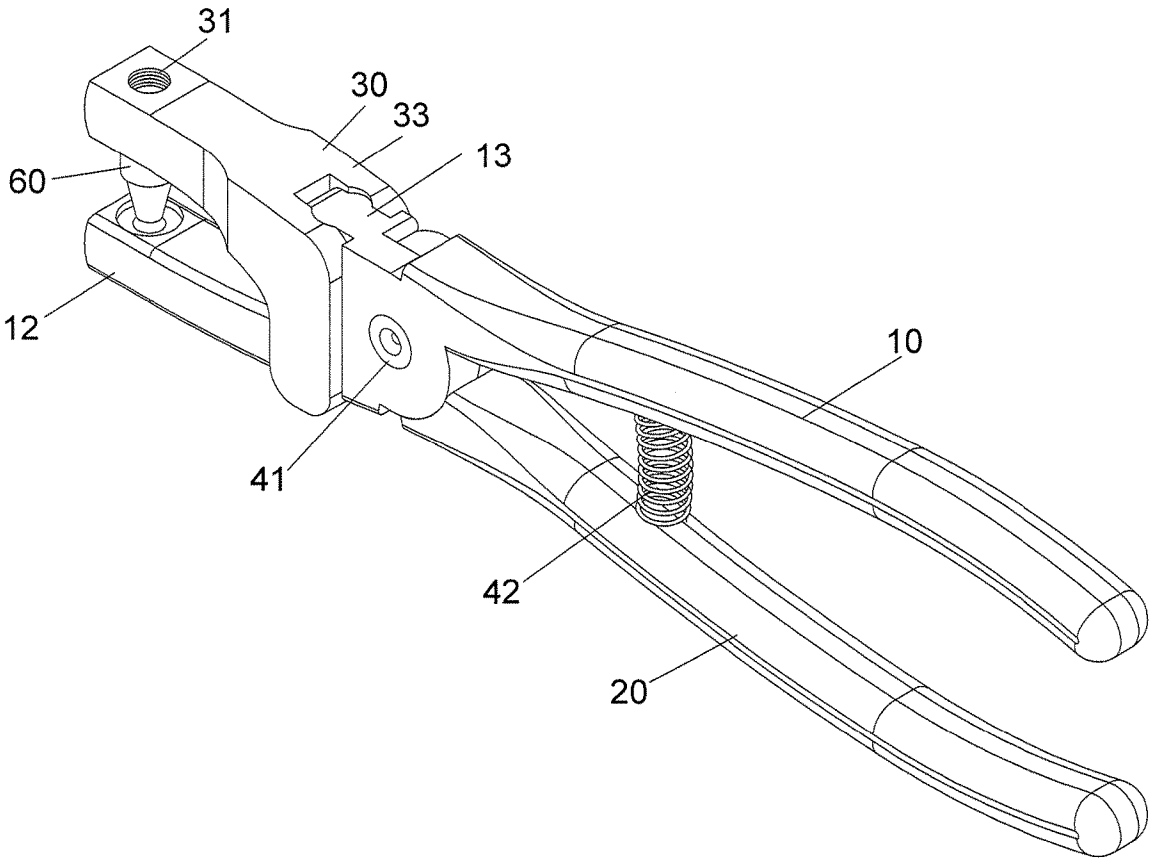
FIG. 12 is a perspective view to show the third embodiment of the turret punch of the present invention.

As shown in FIG. 12 which shows the third embodiment of the present invention, wherein the second function end 31 of the third body 30 is a threaded hole.

There is one function member 60 which is threadedly connected to the second function end 31. The first body 10 does not have the first recess 111 and the first engaging slot 112. The second body 20 does not have the second recess 211 and the second engaging slot 212. The first resilient member 42 is a spring which biases the first and second bodies 10, 20 and protrudes beyond the turret punch. The first resilient member 42 is located between the first and second bodies 10, 20 to resiliently bias the first and second bodies 10, 20.

Figure 13:
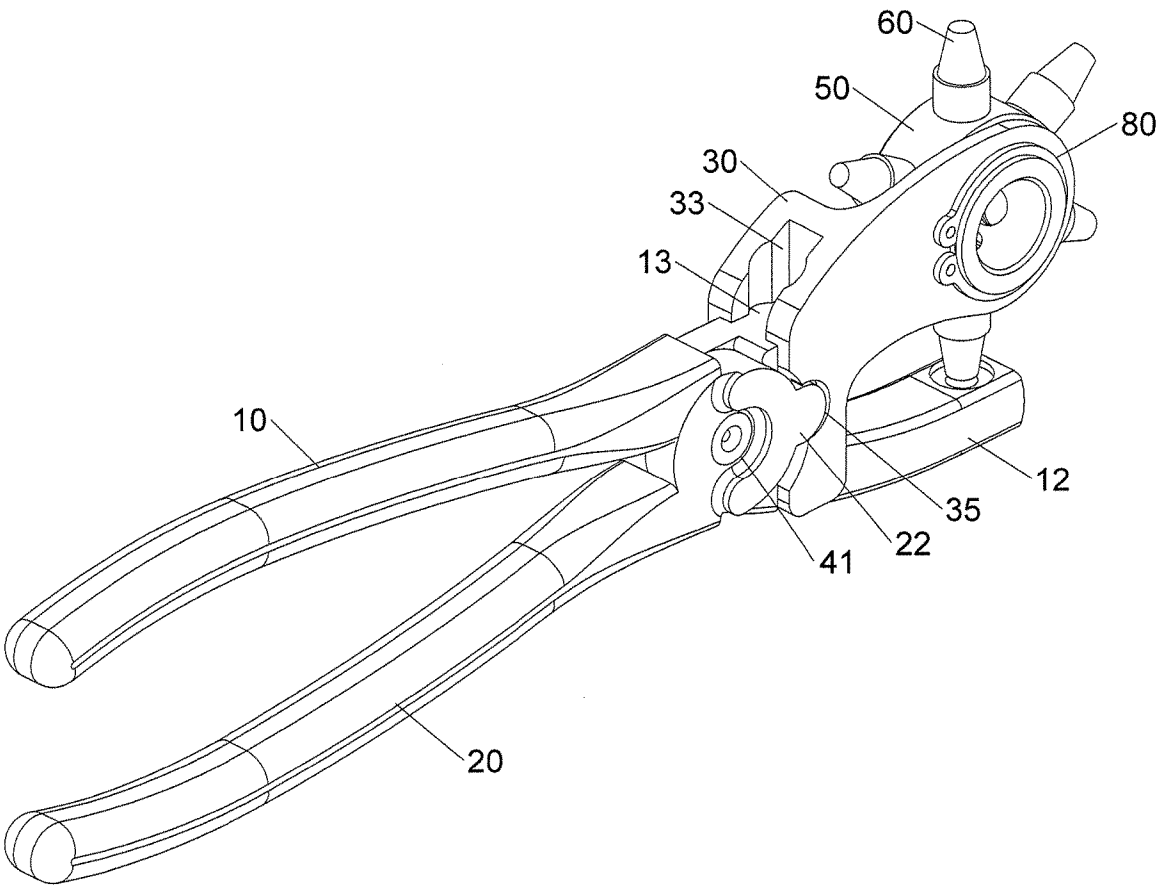
FIG. 13 is a perspective view to show the fourth embodiment of the turret punch of the present invention.

As shown in FIG. 13 which shows the fourth embodiment of the present invention, wherein the first body 10 does not have the first control recess 14. The second control recess 34 and the third control recess 35 of the third body 30 are located on the outside of the second rail portion 33. The control portion 22 is exposed from outside of the second body 20.

Figure 14:
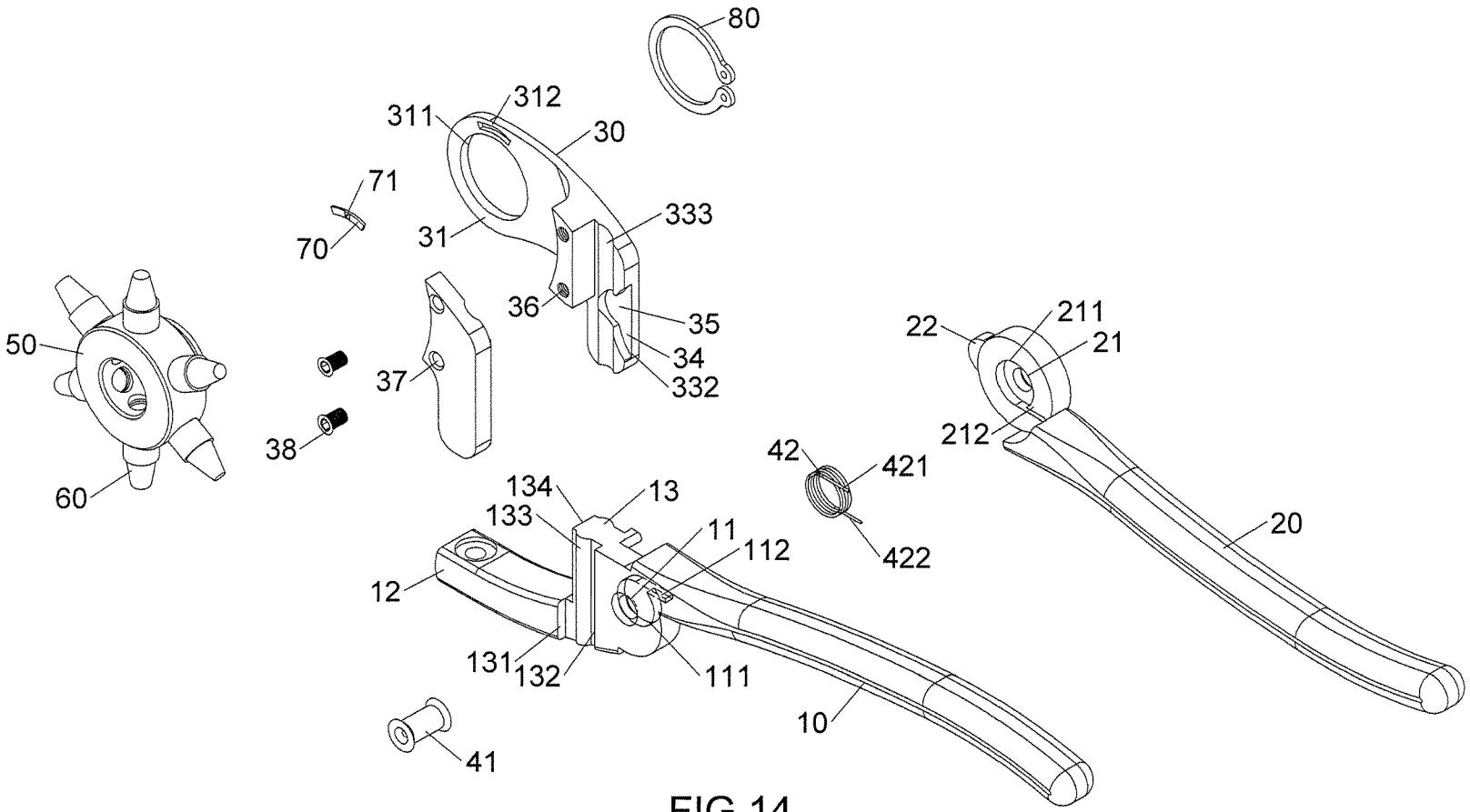
FIG. 14 is an exploded view of the fifth embodiment of the turret punch of the present invention.
Figure 15:
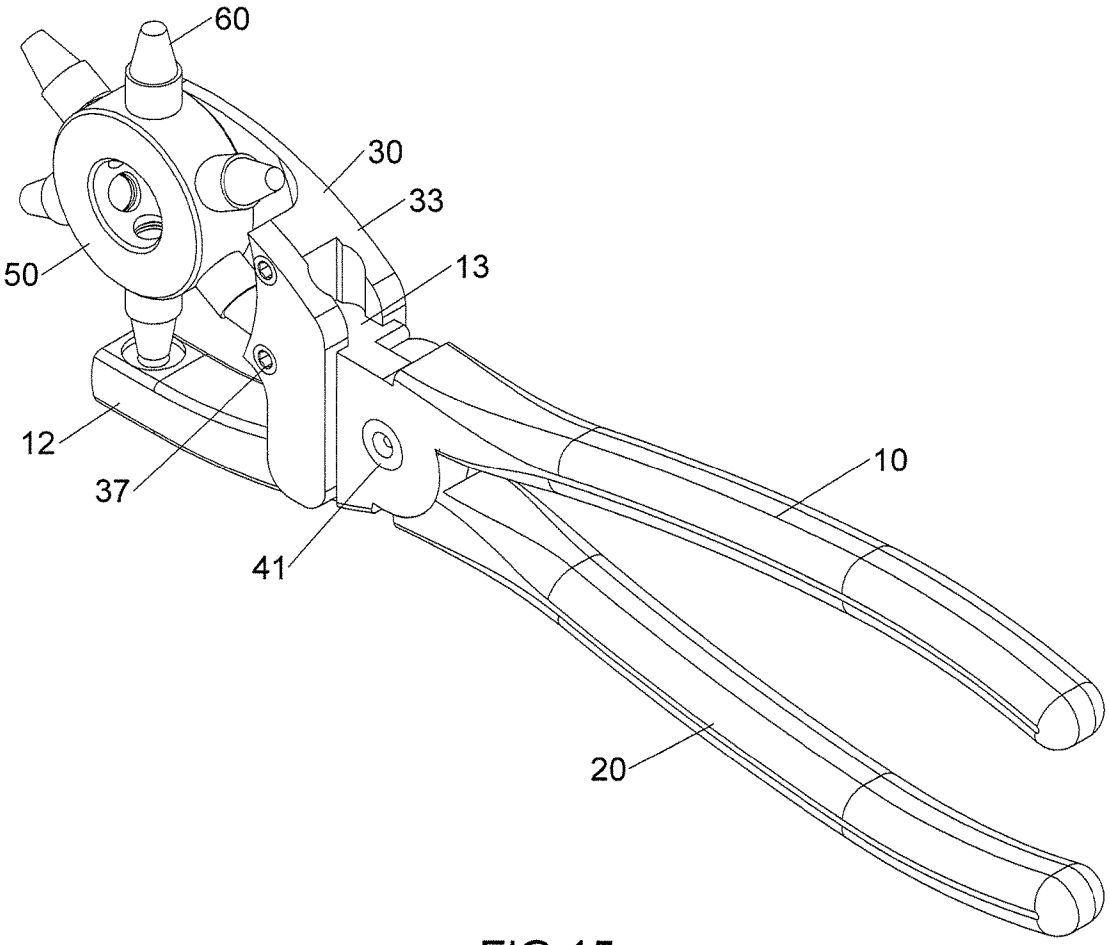
FIG. 15 is a perspective view to show the fifth embodiment of the turret punch of the present invention.

As shown in FIGS. 14 and 15, which shows the fifth embodiment of the present invention, wherein the third body 30 is composed of two parts. One of the two parts has two threaded hole 36, and the other part has two through holes 37. Two bolts 38 extend through the two through holes 37 and are threadedly connected to the two threaded holes 36 to connect the two parts into the third body 30 which has the same function as the integral third body 30.

A further embodiment of the present invention shows that the control portion 22 is a single part which is connected to the second body 20.

The present invention includes the following advantages:

As shown in FIGS. 9 and 10, which show the first and second operational statuses. When the user pushes the two respective handles of the first and second bodies 10, 20, the control portion 22 of the second body 20 drives the second rail portion 33 of the third body 30 to linearly move along the first rail portion 13 of the first body 10. The function member 60 that is located corresponding to the first function end 12 moves linearly so as to be engaged with or to be disengaged from the first function end 12 of the first body 10, such that the holes are punched along a straight line.

The control portion 22 of the second body 20 is a rounded protrusion, the third control recess 35 of the third body 30 is shaped to accommodate the control portion 22. The diameter of the third control recess 35 is larger than that of the control portion 22.

Any one of the positioning portions 53 of the turret 50 is located corresponding to the reception slot 312. The second resilient member 70 is located in the reception slot 312 of the third body 30. The second positioning portion 71 protrudes beyond the reception slot 312. The second positioning portion 71 is engaged with any one of the positioning portions 53 so as to change the function members 60 by rotating the turret 50 and to prevent the turret 50 from freely rotating. The turret 50 is positioned by the second resilient member 70.

The turret 50 is pivotably connected to the second function end 31 of the third body 30. The second positioning portion 71 is hidden in the reception slot 312. When the turret 50 is pivotably connected to the third body 30, the reception slot 312 and the second positioning portion 71 are hidden by the turret 50. The positioning portions 53 are hidden by the second function end 31 of the third body 30. The first positioning portions 53 and the second positioning portion 71 are hidden by the turret punch so as have an aesthetic outer appearance.

The first resilient member 42 is hidden in the first recess 111 of the first body 10 and the second recess 211 of the second body 20 so that the first resilient member 42 cannot be seen from outside of the turret punch which has an aesthetic outer appearance.

While we have shown and described the embodiment in accordance with the present invention, it should be clear to those skilled in the art that further embodiments may be made without departing from the scope of the present invention.

What is claimed is:

1. A hand-held turret punch comprising:

a first body having a first pivotal hole, a first function end formed at a distal end thereof, a first rail portion formed between the first pivotal hole and the first function end, each of two sides of the first rail portion having a first side and a second side which is parallel to the first side and faces the first side with a distance located therebetween, a third side formed between the first and second sides on each side of the first rail portion, a fourth side formed at an end of the first rail portion and being perpendicular to each of the first sides;

a second body having a second pivotal hole which is located corresponding to the first pivotal hole, a control portion formed at a distal end of the second body and being a protrusion;

a third body connected to the first body and having a second function end on a first end thereof, the second function end located corresponding to the first function end, a second rail portion formed in a second end of the third body, the first rail portion slidably engaged with the second rail portion, the second rail portion having inner portions each having a fifth side and a sixth side, the fifth sides slidably engaged with the first sides, the sixth sides slidably engaged with the second sides, a seventh side defined in each of the inner portions of the second rail portion and slidably engaged with the third sides, an eighth side formed at the second rail portion and slidably engaged with the fourth side, the second rail portion having a second control recess with which a portion with the second recess is accommodated, a third control recess defined in the second rail portion and communicating with the second control recess, the control portion being accommodated in the third control recess, when the second body is pivoted about the first pivotal hole, the control portion pushing the third control recess to linearly move the second rail portion along the first rail portion so as to move the second function end of the third body close to or away from the first function end;

a pin extending through the first and second pivotal holes to pivotably connect the first body to the second body;

a first resilient member located between the first and second bodies to resiliently bias the first and second bodies, and at least one function member located corresponding to the first function end of the first body, when a handle of the first body and a handle of the second body are pushed, the control portion of the second body controls and drives the second rail portion of the third body to move linearly along the first rail portion of the first body, so that the at least one function member located corresponding to the first function end is linearly engaged with the first function end to punch a straight hole.

2. The hand-held turret punch as claimed in claim 1, wherein the first pivotal hole has a first recess and a first engaging slot, the first pivotal hole co-axially communicates with the first recess, the first recess has a circular contour and the first engaging slot has a linear projecting portion which extends from the circular contour of the first recess, the second pivotal hole has a second recess and a second engaging slot, the second pivotal hole co-axially communicates with the second recess, the second recess has a circular contour and the second engaging slot has a linear projecting portion which extends from the circular contour of the second recess, the second recess and the first recess define a room, the first resilient member is received in the room defined by the second recess and the first recess, the first resilient member is mounted to the pin, the first resilient member has a first leg and a second leg, the first leg is engaged with the first engaging slot, the second leg is engaged with the second engaging slot, the first body resiliently contacts the second body by the first resilient member.

3. The hand-held turret punch as claimed in claim 1, wherein each third side is a curved and protruded surface and each seventh side is a groove.

4. The hand-held turret punch as claimed in claim 1, wherein the first rail portion has a first control recess defined therein which is located close to the first pivotal hole, the control portion is located in the first control recess and movable along a curved path in the control recess.

5. The hand-held turret punch as claimed in claim 4, wherein the second control recess is located at an inside of the second rail portion and located corresponding to the first control recess, the third control recess is located at the inside of the second rail portion and located corresponding to the first control recess.

6. The hand-held turret punch as claimed in claim 1, wherein the second body is symmetrical to the first body.

7. The hand-held turret punch as claimed in claim 1, wherein the second function end has a first pivotal portion which is a circular hole, the second function end has a reception slot defined therethrough which is a curved slot; a turret is pivotably connected to the second function end of the third body and has multiple installation holes which are located on an outer circumference of the turret in a circular arrangement, each of the installation holes includes inner threads; a second pivotal portion is defined centrally of the turret and pivotably connected with the first pivotal portion, a connection portion is a groove and located on an outside of the second pivotal portion, multiple positioning portions are located on a surface surrounding a circumference of the second pivotal portion where the second pivotal portion extends, at least one of the positioning portions is located corresponding to the reception slot, the second pivotal portion has a passage which is a circular passage; each installation hole receives one of the multiple function members, each of the function members is located corresponding to the first function end of the first body; a second resilient member is received in the reception slot of the third body and has a second positioning portion which is a ridge and protrudes beyond the reception slot, the second positioning portion is engaged with any one of the positioning portions so as to change the function members by rotating the turret and to prevent the turret from freely rotating; the turret is positioned by the second resilient member which is an integral member, a connector is engaged with the connection portion and contacts an outside of the second function end so that the turret is restricted by the connector and is not disengaged from the second function end.

8. The hand-held turret punch as claimed in claim 1, wherein the control portion of the second body is a rounded protrusion, the third control recess of the third body is shaped to accommodate the control portion, a diameter of the third control recess is larger than that of the control portion.

* * * * *